US008216987B2

(12) United States Patent
Han et al.

(10) Patent No.: US 8,216,987 B2
(45) Date of Patent: Jul. 10, 2012

(54) CLEANING AGENT FOR HIGH VISCOSITY METALWORKING FLUID

(75) Inventors: Du Hee Han, Incheon (KR); Tae Gi Kim, Ansan-si (KR)

(73) Assignee: Woorifinechem. Co. Ltd, Sa-dong, Sangrok-gu, Ansan-si, Gyeonggi-do (KR)

( * ) Notice: Subject to any disclaimer, the term of this patent is extended or adjusted under 35 U.S.C. 154(b) by 0 days.

(21) Appl. No.: 13/131,864

(22) PCT Filed: Nov. 30, 2009

(86) PCT No.: PCT/KR2009/007073

§ 371 (c)(1),
(2), (4) Date: May 27, 2011

(87) PCT Pub. No.: WO2010/074413

PCT Pub. Date: Jul. 1, 2010

(65) Prior Publication Data

US 2011/0237483 A1 Sep. 29, 2011

(30) Foreign Application Priority Data

Dec. 22, 2008 (KR) ..... 10-2008-0131594

(51) Int. Cl.
*C11D 7/22* (2006.01)
*C11D 7/26* (2006.01)
*C11D 7/50* (2006.01)

(52) U.S. Cl. ..... 510/188; 510/174; 510/199; 510/200; 510/201; 510/245; 510/505; 510/506

(58) Field of Classification Search ..... 510/174, 510/199, 200, 201, 245, 254, 505, 506, 188
See application file for complete search history.

(56) References Cited

U.S. PATENT DOCUMENTS

| | | | | |
|---|---|---|---|---|
| 7,901,515 | B1 * | 3/2011 | Badesha et al. | 134/26 |
| 2002/0111284 | A1 * | 8/2002 | Machac et al. | 510/245 |
| 2003/0083220 | A1 * | 5/2003 | Doyel et al. | 510/412 |
| 2005/0143276 | A1 * | 6/2005 | Hanada | 510/412 |
| 2008/0125342 | A1 * | 5/2008 | Visintin et al. | 510/175 |
| 2009/0229633 | A1 * | 9/2009 | Kabashima et al. | 134/11 |

FOREIGN PATENT DOCUMENTS

| | | |
|---|---|---|
| JP | 2006-199939 | 8/2006 |
| KR | 10-2006-0105942 | 10/2006 |
| KR | 10-2008-0042938 | 5/2008 |
| KR | 10-2008-0045616 | 5/2008 |

OTHER PUBLICATIONS

International Search Report for PCT/KR2009/007073 mailed Jul. 6, 2010.

* cited by examiner

*Primary Examiner* — Gregory Delcotto
(74) *Attorney, Agent, or Firm* — Christopher Paul Mitchell

(57) ABSTRACT

The present invention relates to a agent for cleaning metal drawing oil, which contains alcohol, glycol ether, water, and one or more compounds selected from hydrocarbon or ester compounds. The cleaning agent according to the present invention is environmentally friendly because it does not contain halogen elements such as chlorine. The agent can reduce toxicity on the human body due to low volatility; is economical due to the long change period resulting from the reduction of evaporation; and removes drawing oil having high viscosity and polarity effectively during metal processing.

3 Claims, No Drawings

CLEANING AGENT FOR HIGH VISCOSITY METALWORKING FLUID

BACKGROUND OF THE INVENTION

1. Field of the Invention

The present invention relates to a composition for cleaning, which can effectively remove metal processing oil after metal processing, especially metal drawing.

2. Description of the Related Art

A composition containing a chlorine-based solvent, such as 1,1,2-trichloroethylene (TCE), 1,2-dichloropropane, methylenechloride, and the like, has been used as a solvent for removing processing oil that is used for a conventional metal processing, for example, cutting, pressing, drawing, and the like. However, since the chlorine-based solvent has high volatility thereby being harmful both to the human body and environment, the researches about a cleaning agent for replacing the chlorine-based solvent are proceeding.

The hydrocarbon-based cleaning agent has been widely used as the substitute cleaning agent, but the problems that relate to flammability and drying about the hydrocarbon-based cleaning agent are being blamed. In addition, a cleaning agent containing an aromatic-based hydrocarbon, such as benzene, xylene, and the like is being regulated because it has high toxicity on the human body and high environmental pollution.

The techniques about a semi-aqueous or water-based cleaning agent containing water are being developed considering working safety, such as a safety about the human body, a stability about flammability, and the like. The cleaning agent containing water has low solubility in oil so that the system development using a proper organic solvent and surfactant is required in order to improve the above low solubility in oil.

Meanwhile, Japanese Publication Patent No. 1994-146041 discloses a cleaning composition containing propylene glycol ether and water as a semi-aqueous cleaning agent for removing metal processing oil. In addition, Korean Publication Patent No. 2008-0045616 discloses a cleaning agent containing hydrocarbon-based solvent and acetate-based compound as a hydrocarbon-based cleaning agent for cleaning surface pollutants of electronic components, precision parts, and the like in machine, electronic and electron fields. However, the cleaning compositions disclosed in the above patents have high viscosity, and do not have the sufficient detergency about metal drawing oil that is plentifully substituted with halogen elements.

DETAILED DESCRIPTION OF THE PREFERRED EMBODIMENT

Technical Problems

An object of the present invention is to provide a cleansing composition, in which the cleansing composition is environmentally friendly because it does not contain halogen elements, such as chlorine; has low toxicity on the human body due to low volatility; is economical due to the long change period resulting from the reduction of evaporation; and also can effectively remove drawing oil having high viscosity and polarity during metal processing.

The present invention is designed to solve the above technical problems, and relates to a cleansing composition containing one or more one selected from hydrocarbon-based compound or ester-based compound except an aromatic hydrocarbon, alcohol, glycol ether, and water.

More specifically, the present invention provides a cleansing composition for removing metal drawing oil, in which the cleansing composition contains (a) 20~65 wt % of C5~C20 hydrocarbon, C4~C10 ester, or the mixture thereof, (b) 10~60 wt % of C3~C10 alcohol, (c) 1~40 wt % of C2~C10 glycol ether, and (d) 1~20 wt % of water.

The metal drawing oil is oil having high viscosity that is used for metal drawing, and the chloroparaffin-based oil having high viscosity that is used for drawing of stainless steel pipe cannot be sufficiently removed with the existed chlorine-based cleansing agent, such as trichloroethylene, and the like. In addition, there is a problem such that the existed solvent containing halogen elements, such as trichloroethylene, and the like has high specific gravity so that the insoluble component that is contained in drawing oil when cleansing is floated on the surface, and then the floated component is re-contaminated on the metal surface when moving to follow-up processing after cleansing. If the pollutant is left on the metal surface, carbide of the pollutant is penetrated into the material thereby causing of modifying the characteristics of the material and spots on the material surface in a heat treatment processing that is follow-up processing of drawing product. The product produced in this case is impossible to apply in a higher value-added industry that should use a pipe having high clean, such as for semiconductor or medicinal purposes. Therefore, a cleaning composition having low specific gravity is required so that it should well dissolve a chloroparaffin-based oil component and also should precipitate the additional agents that are difficult to be dissolved. In addition, it is preferable that the cleansing agent has low volatility so that it has low toxicity on the human body and has low loss due to the evaporation.

The cleansing composition according to the present invention has low toxicity that affects the human body due to its low flammability and volatility and is environmentally friendly because it does not contain halogen elements. Furthermore, the cleansing composition according to the present invention can effectively remove processing oil mainly containing hydrocarbon-based material that is plentifully substituted with halogen and has high viscosity as chloroparaffin-based oil that is used for stainless steel drawing, and also has low specific gravity as compared with the chlorine-based cleansing agent, such as 1,1,2-trichloroethylene, and the like that has been traditionally used so that it can precipitate an insoluble material thereby solving the problem such that the above insoluble material is caused of re-contaminating on the metal surface.

Hereinafter, the present invention will be described in more detail.

At this time, the technical terms and scientific terms have the meanings that can be generally understood by the person who is skilled in the art belong to the present invention if there are not any definitions. In addition, the repetitive descriptions about the same technical constitutions and functions with the existed one will be omitted.

The present invention provides a cleansing composition containing the components as follows:

(a) 20~65 wt % of one or more one of C5~C20 hydrocarbon, C4~C10 ester, or the mixture thereof;

(b) 10~50 wt % of C3~C10 alcohol;

(c) 1~40 wt % of C2~C10 glycol ether; and (d) 1~20 wt % of water.

The hydrocarbon is an alicyclic or aliphatic hydrocarbon without an aromatic ring, and single hydrocarbon material or the mixture of one or more hydrocarbon material can be used. Examples of the alicyclic hydrocarbon include cyclopentane, cyclohexane, cycloheptane, and the like, and both of linear or branched hydrocarbons can be used as the aliphatic hydrocarbon. It is more preferable that the mixture of C5~C6 alicyclic hydrocarbon and C5~C20 aliphatic hydrocarbon is used. The commercialized product that is mixed with the alicyclic hydrocarbon and the aliphatic hydrocarbon can be used as the hydrocarbon-based solvent, and for example, there are 150 L, 150 or 170 among D-SOL Series from ISU Chemical Corp.

The acetate compounds or the mixture thereof is more preferably used as the ester and the acetate can be represented by the following Chemical Formula 1:

[Chemical Formula 1]

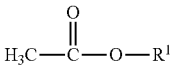

[In the above Chemical Formula 1, $R^1$ is selected from the group consisting of linear or branched (C2~C8) alkyl group]

For example, ethyl acetate, propyl acetate, butyl acetate, pentyl acetate, hexyl acetate, heptyl acetate and octyl acetate can be used as the specific compound, and butyl acetate is more preferably used for removing drawing oil when considering drying speed, a stability about flammability, a compatibility with other components, and the like. The propyl, butyl, phentyl, hexyl, heptyl or octyl group may include linear or branched group.

The cleaning composition according to the present invention includes preferably 20~65 wt %, and more preferably 25~60 wt % of one or more one of the hydrocarbon or ester. If the content is out of the above range, the solubility of the chloroparaffin-based oil having high viscosity is decreased. The reason is that the extreme pressure performance of drawing oil should be maximized in order to minimize the surface roughness of metal in drawing processing so that, to achieve this, phosphorus (P) or sulfur (S) component having high polarity as well as chloroparaffin should be used in great quantities in drawing oil. Therefore, the drawing oil that is used for processing a stainless steel includes the material having high viscosity and high polarity at the same time so that the cleansing agent for dissolving the above drawing oil should be composed to have polarity of the range that can make the solubility to be maximized. The above hydrocarbon or ester is the compound having relative low polarity. Therefore, when the hydrocarbon or ester having the concentration of above the range is used, the polarity of the whole cleaning agent become low so that the solubility is decreased; and when the hydrocarbon or ester having the concentration of less than the range is used, the polarity of the whole cleaning agent become high so that the solubility about the drawing oil is decreased.

It is accepted that the alcohol is composed of linear or branched alkyl group and hydroxy group (—OH) of carbon number 3 to 10, and penetrated between the metal surface and drawing oil so that it has a role in removing the contaminated drawing oil component from the metal surface. One or more one selected from the group consisting of butanol, pentanol, hexanol and heptanol can be used as the specific compound. The content of the alcohol is preferably 10~60 wt %, and more preferably 20 to 50 wt % based on total weight of the composition. When using lower concentration than the above content, it is required to allow more time for removing drawing oil from the metal surface; and when using higher concentration than the above content, there are difficulties such that heating, hot air apparatus, and the like, should be further installed because time for drying become long at the state of natural (room temperature, atmospheric pressure) after cleaning.

It is known that the glycol ether has a role in preventing the re-adsorption of the drawing oil component removed from the metal surface and improving the solubility of drawing oil component. One or more one selected from the group consisting of C3~C10 ethylene glycol monoalkylether can be used, and one or more one selected from the group consisting of ethyleneglycol monoethylether, ethyleneglycol monopropylether or ethyleneglycol monobutylether is more preferably used. The content of the glycol ether is preferably 1~40 wt %, and more preferably 3 to 35 wt % based on total weight of the composition. In the case of getting away from the above content, the drawing oil might be re-adsorbed or the solubility is reduced so that the detergency about the drawing oil may be reduced. Specifically, the glycol ether has an excellent compatibility with the material having high polarity, i.e., water in the cleaning agent or the resolvent of the additional agents having high polarity in the drawing oil so that it can make insoluble floating matters to be minimized, in which the floating matters are generated during cleaning. Therefore, the glycol ether is effective in maintaining the clean degree of cleaning agent.

Water has a role in controlling the polarity of the composition for cleaning according to the present invention, and 1 to 20 wt % of water is suitable for removing drawing oil. In the case of the composition for removing chloroparaffin-based oil having high viscosity that is used as drawing oil of stainless steel among drawing oils, 3 to 15 wt % of water is more preferably used.

According to the preferable example according to the present invention, the composition for cleaning metal drawing oil includes (a) 25~65 wt % of the mixture of C5~C6 alicyclic hydrocarbon and C5~C20 aliphatic hydrocarbon, butyl acetate or the mixture thereof, (b) 20~50 wt % of butanol, (c) 3~35 wt % of one or more one selected from the group consisting of ethylene glycol monoethylether, ethyleneglycol monopropylether or ethyleneglycol monobutylether, and (d) 3~15 wt % of water.

Advantageous Effects

The cleaning composition according to the present invention has low toxicity on the human body due to low flammability and volatility, is environmentally friendly because it does not contain halogen element, and also can effectively remove chloroparaffin-based metal drawing oil having high viscosity.

BEST MODE

Hereinafter, the present invention will be described in detail with reference to Examples, and the range of the present invention will not be limited thereto, but only for understanding the constitution and effects of the present invention.

EXAMPLE

The cleaning composition was prepared as the components disclosed in the following Table 1. HY in the following Table 1 was the mixture of the alicyclic and aliphatic hydrocarbons that was the mixture of cyclopentane, cyclohexane, octane, and dodecane in the weight ratio of 3:3:2:2. ES was butylacetate, Al was butanol, GE1 was ethoxyethanol, and GE2 was butoxybutanol.

Solubility Test

The solubility test of chloroparaffin-based drawing oil (Manufacturing Company: Hangsterfer, USA, Product Name: Drawing Oil J-2) having high viscosity that was used for drawing of stainless steel pipe was performed. The solubility test was performed as follows: 10 ml of each cleaning composition was putted into a transparent test-tube; 1 g of the above drawing oil was added to the above test-tube; after 30 minutes, the transparency of the agent and the behavior of the insoluble matters were determined. After evaluating the transparency of the agents, the results shown as follows: if the agent was opaque, it marked with poor (X); if the agent is semi-transparent, it marked with average (Δ); if the agent had a little turbidity, it marked with good (○); and if the agent was completely transparent, it marked with excellent (◎). Referring to the results from the following Table 1, the performances of the solubility were different according to the components and the contents of the compositions, and the cleaning composition according to the present invention had an excellent performance of the solubility about drawing oil having high viscosity. In the case of the chlorine-based cleaning agents according to Comparative Example 7 to Comparative Example 9, there were problems such that they had a poor solubility about drawing oil having high viscosity, and also they had high specific gravity so that the insoluble matters were not precipitated.

Test by Amount of Remained Oil and Appearance of Metal Surface after Cleaning

A specimen was prepared by cutting in 30 mm size of stainless steel pipe having 12 mm in diameter that was drawn using chloroparaffin-based drawing oil (Manufacturing Company: Hangsterfer, USA, Product Name: Drawing Oil J-2) having high viscosity. The surface of the above specimen was adhered with drawing oil that was used for processing so that the weight that was added with the specimen and the adhered drawing oil was calculated down to four places of decimals and then recorded. The above specimens were immersed in 10 mL of each cleaning composition disclosed in the following Table 1 for 10 minutes to dissolve drawing oil in the cleaning agent. After that, the specimens were dried and declines in specimens' weights were measured. And then, the state of each metal surface was observed using a microscope. The above specimens, in which the weights of the specimens were decreased due to the decline of oil were extracted for 3 hours with Soxhlet apparatus using toluene solvent to completely remove the oil remained on the surface and then dried. And then, the weights (only specimen's weight) were again measured. Using the above values, the amount of oil that was initially adhered on the specimen and the amount of oil that was removed by the cleaning agent were calculated and putted on a percentage basis. The above values were compared through expressing by symbols that set the range based on 80%, 95% and 99%. That is, when less than 80% of the amount of initial oil that was adhered on the specimen was removed, it marked with poor (X); when above 80~less than 95% was removed, it marked with average (Δ); when above 95%~less then 99% was removed, it marked with good (○); and when above 99% was removed, it marked with excellent (◎). In addition, when oil was remained, the oil was observed using a microscope. Referring to the results of the following Table 1, it could be known that in the case of the composition of Examples according to the present invention, the pollutants of the surface were completely removed, and actually the pollutants of the surface was not shown using a microscope. However, it could be known that in the cases of the compositions according to Comparative Examples, a part or a plenty of pollutants were remained.

TABLE 1

| | Cleaning Composition | Mix Ratio (wt %) | Water Content (wt %) | Solubility (Transparent) | Test* |
|---|---|---|---|---|---|
| Example 1 | HY/ES/Al/GE1 | 25/25/37/10 | 3 | ◎ | ◎ |
| Example 2 | ES/Al/GE1 | 33/32/32 | 3 | ◎ | ◎ |
| Example 3 | HY/AL/GE1 | 33/32/32 | 3 | ◎ | ◎ |
| Example 4 | HY/ES/Al/GE2 | 29/29/34/4 | 4 | ◎ | ◎ |
| Example 5 | ES/Al/GE2 | 43/43/10 | 4 | ◎ | ◎ |
| Example 6 | HY/AL/GE2 | 43/43/10 | 4 | ◎ | ◎ |
| Example 7 | ES/Al/GE1 | 40/35/10 | 15 | ◎ | ◎ |
| Com. Ex. 1 | HY/ES | 49/49 | 0.2 | Δ | Δ |
| Com. Ex. 2 | HY/ES/AL | 33/33/32 | 0.2 | ○ | ○ |
| Com. Ex. 3 | HY/ES/AL/GE1 | 25/25/24/24 | 0.2 | ○ | ○ |
| Com. Ex. 4 | ES/GE2 | 50/49.5 | 0.5 | Δ | ○ |
| Com. Ex. 5 | ES/AL | 50/49.5 | 0.5 | Δ | X |
| Com. Ex. 6 | GE1/Al | 48/50 | 2 | Δ | ○ |
| Com. Ex. 7 | Trichlorethylene | 99.9 | 0.01 | ○ | ○ |
| Com. Ex. 8 | 1,2-Dichlopropane | 99.9 | 0.01 | Δ | ○ |
| Com. Ex. 9 | methylene chloride | 99.9 | 0.01 | Δ | ○ |

*Test by Amount of Remained Oil and Appearance of Metal Surface

What is claimed is:

1. A composition for cleaning chloroparaffin-based stainless steel drawing oil, comprising:

(a) approximately 25 to approximately 60 wt % of a mixture of approximately C5 to approximately C6 alicyclic hydrocarbon and approximately C5 to approximately C20 aliphatic hydrocarbon, butyl acetate or the mixture thereof;

(b) approximately 20 to approximately 50 wt % of butanol;

(c) approximately 3 to approximately 35 wt % of a glycol ether selected from the group consisting of ethyleneglycol monoethylether, ethyleneglycol monopropylether or ethyleneglycol monobutylether; and (d) approximately 3 to approximately 15 wt % of water.

2. The composition according to claim 1, wherein the mixture of the alicyclic hydrocarbon and the aliphatic hydrocarbon is the mixture of cyclopentane, cyclohexane, octane and dodecane in the weight ratio of 3:3:2:2.

3. The composition according to claim 1, wherein component (a) is butyl acetate.

* * * * *